United States Patent [19]

Smith

[11] Patent Number: 4,867,725

[45] Date of Patent: Sep. 19, 1989

[54] HORN FOR CONTROL SURFACES OF MODEL AIRCRAFT

[75] Inventor: Mark A. Smith, San Marcos, Calif.

[73] Assignee: Aero Toys, Incorporated, Reseda, Calif.

[21] Appl. No.: 140,440

[22] Filed: Jan. 4, 1988

[51] Int. Cl.[4] ..... A63H 27/00; A63H 27/20

[52] U.S. Cl. ..... 446/34; 446/32; 411/510

[58] Field of Search ..... 446/30–34, 446/57, 56, 58; 411/510, 509, 508, 339; 244/75 R, 131; 248/71

[56] References Cited

U.S. PATENT DOCUMENTS

| | | | |
|---|---|---|---|
| 562,491 | 6/1896 | Schoup | 411/510 X |
| 3,489,054 | 1/1970 | Feldman | 411/510 |
| 3,738,217 | 6/1973 | Walker | 411/510 |
| 3,905,570 | 9/1975 | Nieuwveld | 248/71 |
| 4,067,139 | 1/1978 | Pinkerton et al. | 446/31 |

OTHER PUBLICATIONS

American Modeler, Dec. 1959, vol. 53, No. 3, pp. 29, 59.

*Primary Examiner*—Mickey Yu
*Attorney, Agent, or Firm*—Donald D. Mon

[57] ABSTRACT

A horn for attachment to a control surface of a model aircraft. The horn includes a spine to pass through the structure, a shoulder to bear against one face of the structure, and a unidirectional abutment body applicable to the spine to bear against the other side of the control surface. A horn projection extends from the spine to receive a push-pull actuator to establish the position of the control surface.

11 Claims, 1 Drawing Sheet

HORN FOR CONTROL SURFACES OF MODEL AIRCRAFT

FIELD OF THE INVENTION

This invention relates to horns for model aircraft by means of which a push-pull actuator can be attached to a pivoted control surface, such as an aileron or a rudder.

BACKGROUND OF THE INVENTION

Flyable model aircraft are generally driven by a propeller which in turn is driven by a small internal combustion engine. They are light weight structures largely made of low density materials such as balsa wood, so as to provide as large a lifting area relative to gross weight as possible. These craft characteristically have fixed wings, fixed vertical and horizontal stabilizers, a hinged rudder and hinged ailerons. The rudder and ailerons are hinged to fixed structure such as a wing or stabilizer, and are positioned by push pull actuators, which in turn are controlled by radio signals.

In order to connect the hinged rudder and ailerons to the actuator it is conventional practice to attach horns to them. The horn is rigidly attached to the rudder or aileron, and projects radially beyond the center of rotation of the hinge so as to act as a lever and exert a torque on the control surface to position it relative to the fixed surface. Horn structures for this purpose are well-known, and are used on every practical model, remotely controllable aircraft.

Full aircraft also utilize control horns, but their attachment to a hinged surface is generally a rather pedestrian sort of thing. The full aircraft has substantial areas and cross-sections of structural members to which the horn can readily be attached. Bolted, cemented and threaded attachments are common.

Structural standards of passenger carrying aircraft and of model aircraft are, of course, very different from one another. For one thing, the safety factors and redundant designs which must be incorporated in manned aircraft are pointless or at least redundant as to model craft. The encountered and applied forces in model aircraft would be considered negligible in any load carrying or passenger carrying aircraft.

For this reason and for other reasons, the criteria for a suitable control horn for model aircraft are unique to this field. A practical horn must be simple in construction, light in weight, easy to install correctly, and be reliably retained once it is installed. In addition, because this is primarily a hobby field, the device must be affordable.

Prior art horns for model aircraft do exist. They perform the same function after installation as the device of this invention performs after it is installed. However, they generally involve rather complicated means of attachment, or if they do not, then they provide less reliable or less convenient means. More complication leads to higher costs. Less reliability often leads to loss of the craft which is an even greater cost, and also a disappointment to a hobbyist whose pleasure is utlimately related to the length of time his craft survives, and to the performance of his aircraft.

It is an object of this invention to provide a control horn for a model aircraft which can readily and reliably be attached to a pivoted control surface which is structurally elegantly simple, and which can be produced for a very low cost.

BRIEF DESCRIPTION OF THE INVENTION

A control horn according to this invention includes a spine adapted to be passed through a control structure so as to project from both sides of it. A stop shoulder on the spine is so disposd and arranged as to abut one side of the control structure. A retainer is applicable to the spine of the opposite side of the control structure to bear against the opposite side of the control structure, thereby to hold the horn to the structure. The spine includes a lever portion to which actuator means are connected to control the angular position of the control structure.

According to a preferred but optional feature of the invention, the spine is serrated, and the retainer is a plate that can be unidirectionally shoved along the spine to engage successive serrations and to be retained at its closest position relative to the stop shoulder.

According to yet other preferred but optional features of the invention, the spine is pointed to facilitate its passage into and through the control structure, and is readily cut to remove excess length after installation.

The above and other features of this invention will be fully appreciated from the following detailed description and the accompanying drawings, in which:

DETAILED DESCRIPTION OF THE INVENTION

Figure 1:
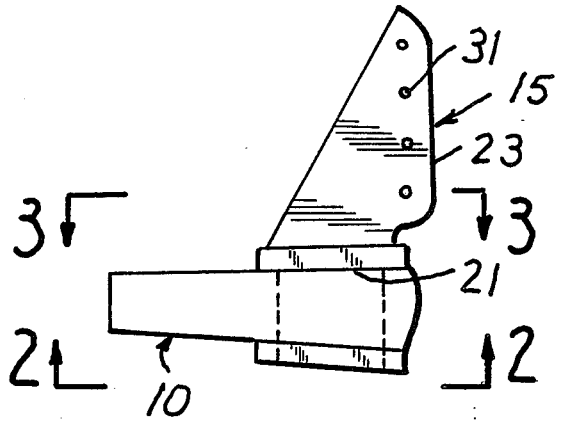
FIG. 1 is a side view of a portion of a control structure with a horn according to this invention attached thereto.
Figure 2:
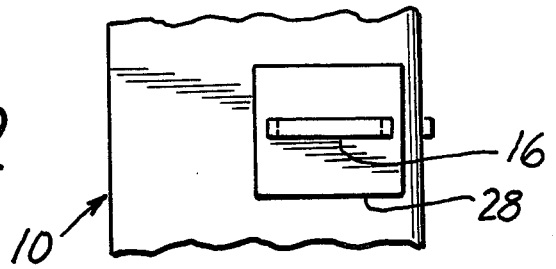
FIG. 2 is a bottom view taken at line 2—2 in FIG. 1.
Figure 3:
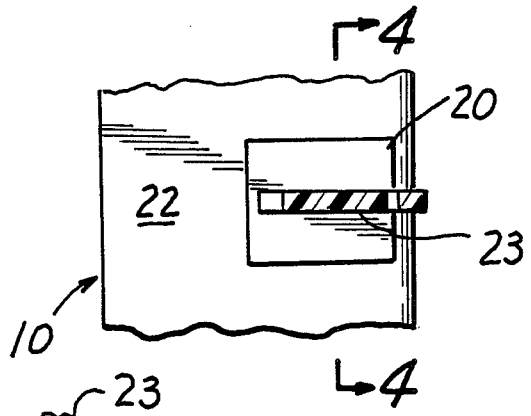
FIG. 3 is a cross-section taken at line 3—3 in FIG. 1.

FIG. 1 shows a fragment of a control structure 10 such as an aileron or a rudder for a model radio-controlled model aircraft. It will be hingedly mounted by a hinge (not shown) to fixed structure such as a wing or a stabilizer. Customarily such control structures are made of low density material such as balsa wood. Such material has little crush strength and is easily cut. Vibratory forces exerted by thin fasteners such as screws soon loosen the attachment.

Figure 4:
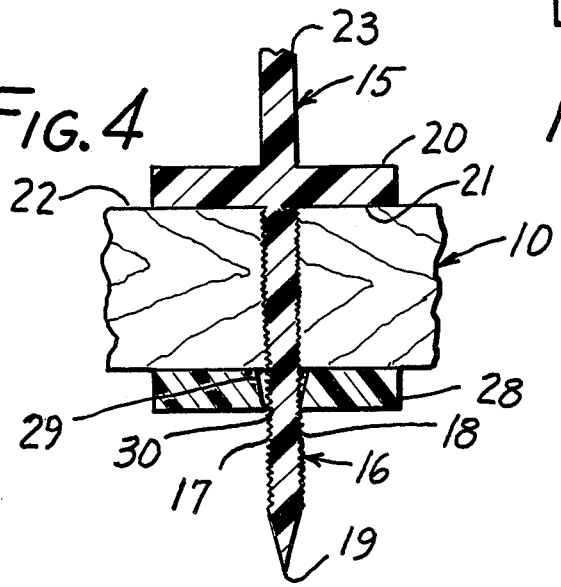
FIG. 4 is a cross-section taken at line 4—4 in FIG. 3.
Figure 5:
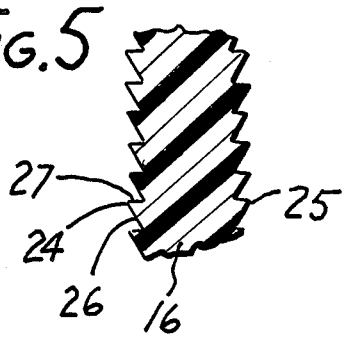
FIG. 5 is an enlarged fragment of FIG. 4.

The presently preferred horn 15 according to this invention is shown in FIGS. 1, 4 and 5. It includes a spine 16 which has generally parallel sides 17, 18 that approach each other near free end 19 to form a taper that facilitates pressing the spine into and through the structure. Preferably, the structure is slit with a knife, without removal of material, and the material presses back closely against the spine. The spine has a width substantially greater than its thickness to form a rectangular cross-section, thereby to facilitate the insertion and to reduce a later tendency to loosen in the structure.

A plate-like stop shoulder 20 projects laterally from the spine. It has a flat abutment surface 21 which will bear against face 22 of the structure. A lever portion 23 extends above the stop shoulder.

Below the abutment surface 21, the spline carries a series of parallel serrations 24,25 (FIG. 5). These may be provided on both sides of the spine, or on only one side as preferred. The serrations are sawtooth types with a ramp face 26 and a stop face 27. The stop face is preferably normal to the spine, while the ramp face slopes to facilitate the passage of a retainer 28 along the spine.

Retainer 28 is plate-like, with a central slot 29 to pass the spine. As shown in FIG. 4, its edges 30 that engage the serrations are tapered so as to cooperate with the ramp faces to facilitate installation. The edge is sharp so as to abut a stop face and prevent separation. Thus this is a unidirectional device. After installation the retainer cannot be pulled off.

Stop shoulder 20, instead of being molded as an integral part with the spine, could be another plate similar to retainer 28.

The tapered edges of the retainer may be inherently flexible, or the retainer itself may be somewhat flexible to enable the retainer to be pressed onto the spine.

Alternatively, unserrated locking means may be used, relying on frictional engagement of the retainer to the spine, or even on a leaf spring device whose function is to dig into the spine if an effort is made to pull off the retainer. The illustrated embodiment is preferred because it is readily molded from organic plastic materials, such as polypropylene, and provides an affordable and reliable device.

A series of apertures, 31 are provided in the level portion to enable an actuator such as a push-pull rod to be connected to it.

To install the device, a slit is preferably cut through the control structure without removal of material. Then the spine is pressed into the structure until the stop shoulder abuts it. This close embrace of the material reinforces the joint. Of course a slot could instead be cut through the structure. The retainer is then shoved onto the spine until it abuts the other side of the structure. The excess length of spine, if any, will be clipped or cut off, and a good, nearly flush end is formed on the spine, leaving sufficient spine length for a serration to be engaged by the slot edges.

Because both the stop shoulder and the retainer can have substantial areas, the spine and lever are held firmly against vibration relative to the structure. This is a long-wearing, easily assembled, and affordable assembly.

This invention is not to be limited by the embodiment shown in the drawings and described in the description, which is given by way of example and not of limitation, but only in accordance with the scope of the appended claims.

I claim:

1. A control structure for a model aircraft that is pivotally mounted to model aircraft structure to control its flight; and a horn assembly comprising:

an elongated spine of a single flat structure, a lever portion positioned in alignment with said spine, a stop shoulder positioned between and joining said spine and lever together, a retainer having a through slot to receive said spine and pass along the same, and unidirectional restraint means enabling said retainer to move toward said stop shoulder, but not away from it, said spine being passed through and frictionally retained in said control structure with said shoulder against one surface of said control structure and the spine projecting from an opposite surface thereof, and said retainer attached to said spine and strongly bearing against said control structure, whereby to hold the horn firmly to said control structure, said shoulder and said retainer having a substantial area in contact with said control structure to resist tilting movement of said horn relative to said control structure.

2. A combination according to claim 1 in which said spine, lever portion, and stop shoulder are integrally formed of a single piece of material.

3. A combination according to claim 2 in which said spine is tapered toward its end away from said stop shoulder to facilitate passage through a slit in the control structure.

4. A combination according to claim 1 in which said lever portion has apertures for connection of an actuator to said lever portion.

5. A combination according to claim 1 in which said unidirectional restraint means comprises serrations along said spine and an edge of said slot in said retainer, said slot receiving said spine, adn said edge engaging said serrations.

6. A combination according to claim 5 in which said serrations are saw-toothed.

7. A combination according to claim 6 in which said edge is defined by surfaces positioned less than ninety degrees from each other.

8. A combination according to claim 1 in which said spine is rectangular in cross-section.

9. A combination according to claim 8 in which said unidirectional restraint means comprises serrations along said spine and an edge of said slot in said retainer, said slot receiving said spine, and said edge engaging said serrations.

10. A combination according to claim 9 in which said serrations are saw-toothed.

11. A combination according to claim 10 in which said edge is defined by surfaces positioned less than ninety degrees from each other.

* * * * *